United States Patent [19]

Hasegaki et al.

[11] Patent Number: 4,936,761

[45] Date of Patent: Jun. 26, 1990

[54] VANE BACKPRESSURE PROVIDING APPARATUS FOR SLIDING VANE TYPE COMPRESSOR

[75] Inventors: Takahiro Hasegaki; Toshio Matsuda, both of Kusatsu, Japan

[73] Assignee: Matsushita Electric Industrial Co., Ltd., Osaka, Japan

[21] Appl. No.: 127,468

[22] Filed: Dec. 2, 1987

[30] Foreign Application Priority Data

Dec. 3, 1986 [JP] Japan ..... 61-287929
Dec. 3, 1986 [JP] Japan ..... 61-287930

[51] Int. Cl.[5] ..... F04C 18/344; F04C 29/02

[52] U.S. Cl. ..... 418/84; 418/87; 418/93; 418/268

[58] Field of Search ..... 418/84, 87, 93, 267–269, 418/DIG. 1

[56] References Cited

U.S. PATENT DOCUMENTS 4,209,287 6/1980 Takada ..... 418/93
4,342,547 8/1982 Yamada et al. ..... 418/93

*Primary Examiner*—John J. Vrablik
*Attorney, Agent, or Firm*—Wenderoth, Lind & Ponack

[57] ABSTRACT

In a sliding vane type compressor including a cylinder having a cylindrical inner wall, a rotor disposed within the cylinder and having a vane slot, and an oil supply means for feeding oil during the rotation of the rotor to the vane backpressure chamber of the vane inserted slidably into the vane slot, refrigerating gas within the refrigeration cycle is used as vane backpressure means, which providing a gas passage opening, closing means is provided in a passage for supplying the gas, the gas passage being shut off during the steady operation of the compressor to cause the oil supply amount to be proper into the vane backpressure chamber to improve the durability and efficiency of the compressor.

2 Claims, 5 Drawing Sheets

VANE BACKPRESSURE PROVIDING APPARATUS FOR SLIDING VANE TYPE COMPRESSOR

BACKGROUND OF THE INVENTION

The present invention generally relates to a vane backpressure providing apparatus for a sliding vane type compressor.

Generally, in the sliding vane type compressor, construction is widely used that the high-pressure lubricating oil is adapted to be fed into the vane rear end through the pressure difference so that the rotation sliding operation may be effected with the vane being in contact at its tip end against the cylinder inner wall through the rotation of the rotor.

One example of a vane backpressure providing apparatus for the above-described conventional sliding vane type compressor will be described hereinafter with reference to the drawings.

FIG. 1 through FIG. 3 show the concrete construction of a sliding vane type compressor having the conventional differential pressure oil-feeding type vane backpressure providing apparatus. In the drawings, the vane backpressure providing apparatus for a sliding vane type compressor includes a cylinder 1 having a cylindrical inner wall, a rotor 2 for forming micro-gap in one portion of its outer periphery with respect to the inner wall of the cylinder 1, a plurality of vane slots 3 disposed in the rotor 2, a plurality of vanes 4 slidably inserted into the vane slot 4, a driving shaft 5 which is formed integrally with the rotor 2 and rotatably supported through an unnumbered shaft, a front side plate 6 and a rear side plate 7 which respectively blockade both the ends of the cylinder 1 to form a working chamber 8 inside, an inlet opening 9 communicating with the working chamber 8 on the side of the low pressure, a discharge opening 10 communicating with the working chamber 8 on the side of the high pressure, a discharge valve 11 arranged in the discharge opening 10, a high-pressure case 12 which forms a high-pressure chamber 14 communicating with the high-pressure passage 13 and has a screen 15 arranged to separate, catch the lubricating oil in the compressed high-pressure fluid, a vane backpressure providing apparatus main-body 16 disposed on the rear side plate 7 to feed into the vane backpressure chamber 17 the lubricating oil of the lower oil storing portion of the high-pressure chamber 14, an oil supply passage 18 for causing the lower oil-storing portion of the high-pressure chamber 14 to communicate with the vane backpressure chamber 17, a passage 19 for restricting the oil supply amount to be caused through the differential pressure, a first spherical seat 20 provided on the way to the oil-supply passage 18, a first spherical body 21 which is isolated from the first spherical seat 20 or comes into contact against it to cause the oil-supply passage 18 to communicate or to shut it off, a first plunger chamber 22 which opens to the first spherical seat 20 on the side opposite to the first spherical body 21, a first plunger 23 which is arranged slidably within the first plunger chamber 22 to isolate the first spherical body 21 from the first spherical seat 20 when it has been moved onto the side of the first spherical seat 20, a first pressure introducing passage 24 which causes the first lower plunger chamber 25 at the lower end of the plunger to communicate with the working chamber 8 located immediately before the discharge valve 11.

The vane backpressure providing apparatus for a sliding vane type compressor of the above-described construction will be described hereinafter in its operation.

When the driving shaft 5 and the rotor 2 are rotated clockwise in FIG. 2 through the reception of the power transfer from the driving source such as engine or the like, the low-pressure fluid flows into the working chamber 8 from the inlet opening 9. The high-pressure fluid compressed through the rotation of the rotor 2 lifts the discharge valve 11 from the discharge opening 10 to flow into the high-pressure chamber 14 from the high-pressure passage 13, so that the lubricating oil is separated and caught by the screen 15. On the other hand, the excessively compressed gas within the working chamber 8 having the pressure high enough to overcome the pressure of the high-pressure fluid to lift the discharge valve 11 is supplied to the first lower plunger chamber 25 from the first pressure introducing passage 24, and the first plunger 23 moves onto the side of the first spherical seat 20 to isolate the first spherical body 21 from the first spherical seat 20. Accordingly, as the oil supply passage 18 communicates, the lubricating oil which is separated from the high-pressure fluid and is stored in the lower high-pressure chamber 14 is fed into the vane backpressure chamber 17 from the passage 19 and the oil supply passage 18 by the differential pressure to serve for movement of the vane 4. It passes through the gap between the rotor 2 and the front side plate 6 or the rear side plate 7 to flow into the working chamber 8. Also, when the compressor has stopped, the pressure within the working chamber 8 rapidly drops down to the pressure of the fluid on the side of the low pressure, so that the pressure within the first lower plunger chamber 25 also drops down to the pressure of the fluid on the side of the low pressure, the pressure at the lower end of the first plunger 23 becomes smaller than the pressure at the upper end of the first plunger 23. Thus, the first plunger 23 moves onto the side of the first lower plunger chamber 25. The first spherical body 21 comes into the contact against the first spherical seat 20 to shut the oil-supply passage 18. As the lubricating oil is not supplied further, the liquid compression at the start of the compressor, which is caused by the lubricating-oil stay within the working chamber 8, may be prevented from being caused.

However, in such a conventional vane backpressure providing apparatus as described hereinabove, when the compressor starts in a state where the pressure of the fluid on the side of the low pressure has become equal to that of the fluid on the side of the high pressure after the lapse of a certain time after the stopping of the compressor, the vane rotates through the rotation of the rotor to try to extend from/retract within the vane slot. However, as the differential pressure for supplying the lubricating oil does not exist, and the resistance at the flow start through the fluid head, viscosity and inertia of the lubricating oil is large, the large amount of lubricating oil cannot be fed with respect to the volume variation in the vane backpressure chamber to be caused during the extension/retraction of the vane. Therefore, especially when the number of rotations is small at the start of the compressor, pressure reduction of the vane backpressure chamber is caused. The known failure phenomenon where the vane is isolated from the cylinder inner wall and comes into contact against it again or an inferior compression phenomenon where the fluid is not compressed is caused.

Also, to expand the passage area of the passage for retaining the lubricating oil amount depresses the vane excessively against the cylinder inner wall during the steady operation to cause friction increase in the vane tip end portion and the cylinder inner wall, and the input increase of the compressor so as to deteriorate the durability and efficiency of the compressor. The increasing centrifugal force of the vane increases this tendency further during the high rotation.

SUMMARY OF THE INVENTION

Accordingly, an essential object of the present invention is to provide an improved vane backpressure providing apparatus for a sliding vane type compressor, wherein when the compressor is started in a state where the pressure of the fluid on the side of the low pressure has become equal to that of the fluid on the side of the high pressure as in a case where a certain time has passed after the compressor stops, the gaseous fluid, instead of the lubricating oil which is large at the resistance of the flow start through the fluid head, viscosity and inertia, is instantly fed into the vane backpressure chamber so as to prevent the failure phenomenon of the vane or the inferior compression phenomenon thereof.

Another important object of the present invention is to provide the improved backpressure providing apparatus for a sliding vane type compressor, wherein as a gas passage opening, closing means is disposed on the way to the passage for feeding the gaseous fluid, the gas supply passage is shut off when the pressure within the high-pressure chamber increases, so that the proper amount of lubricating oil is fed from the oil-supply passage into the vane backpressure chamber to prevent the durability and efficiency from being damaged.

In accomplishing these and other objects, according to the preferred embodiments of the present invention, there is provided a vane backpressure providing apparatus for a sliding vane type compressor which includes a gas passage communicating with the vane backpressure chamber and the high-pressure case, and a sliding member that is adapted to move upon receiving the pressure of the high-pressure case, and receives at its other end the pressure lower than that within the high-pressure case and the urging force of the spring so as to open or close the gas passage during normal operation.

Even when the compressor has been started in a state where the difference between the low pressure and the high pressure does not exist or is small in accordance with the above-described construction of the present invention, the gas communication opening, closing means causes the first gas supply passage to communicate with the second gas supply passage, so that the gaseous fluid may be fed from the second gas supply passage to the first gas supply passage instantly with respect to the volume variation of the case backpressure chamber caused when the vane is rotated through the rotation of the rotator to extend and retract the vane within the vane slot. As pressure reduction of the vane backpressure chamber is not brought about, the failure phenomenon of the vane or the inferior compression phenomenon may be prevented. Also, the gas passage opening, closing means shuts off the first gas supply passage and the second gas supply passage after the start, and the proper amount of lubricating oil is fed from the oil supply passage into the vane backpressure chamber to prevent the durability and efficiency from being diminished.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
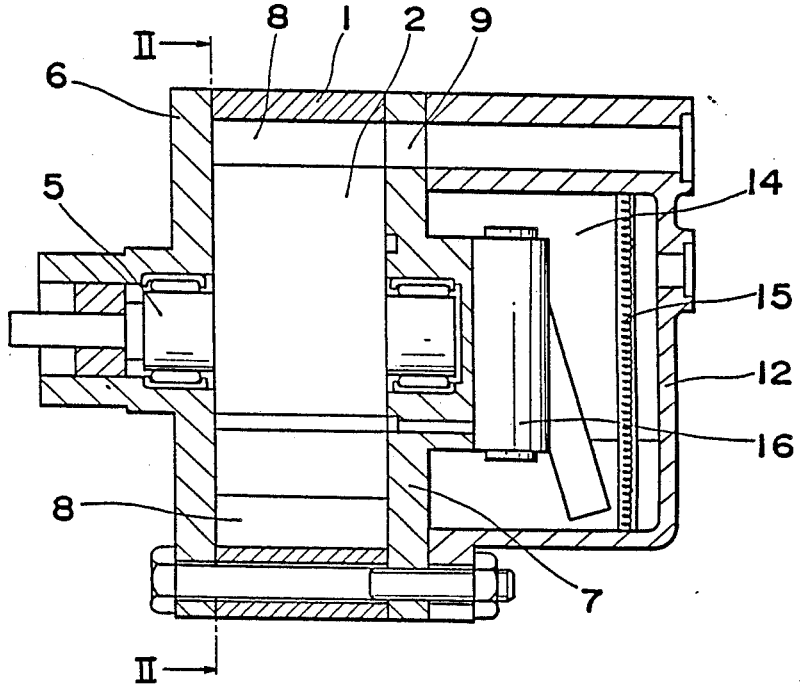
Fig. 1 PRIOR ART
FIG. 1 is a longitudinal, section view of a sliding vane type compressor provided with the conventional vane backpressure providing apparatus, as already referred above.
Figure 2:
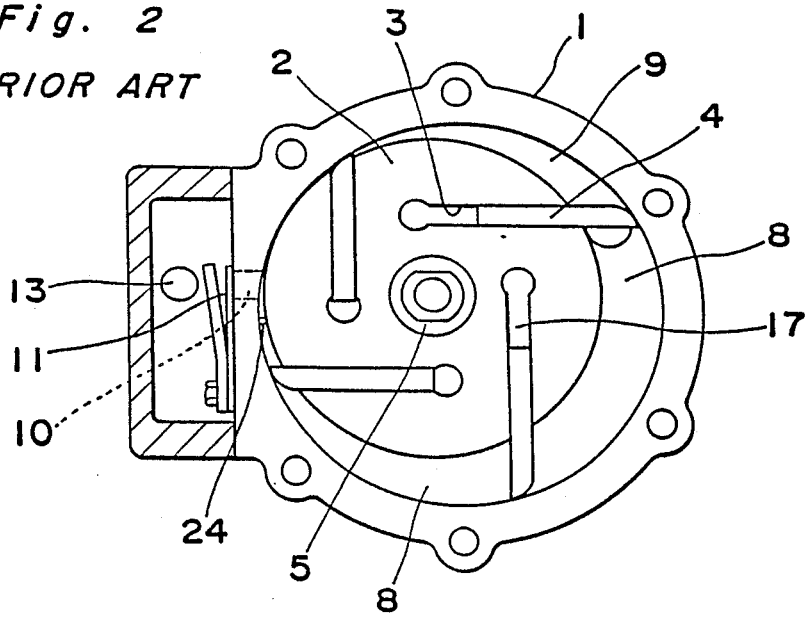
Fig. 2 PRIOR ART
FIG. 2 is a sectional view of the conventional compressor taken along a line II—II of FIG. 1.
Figure 3:
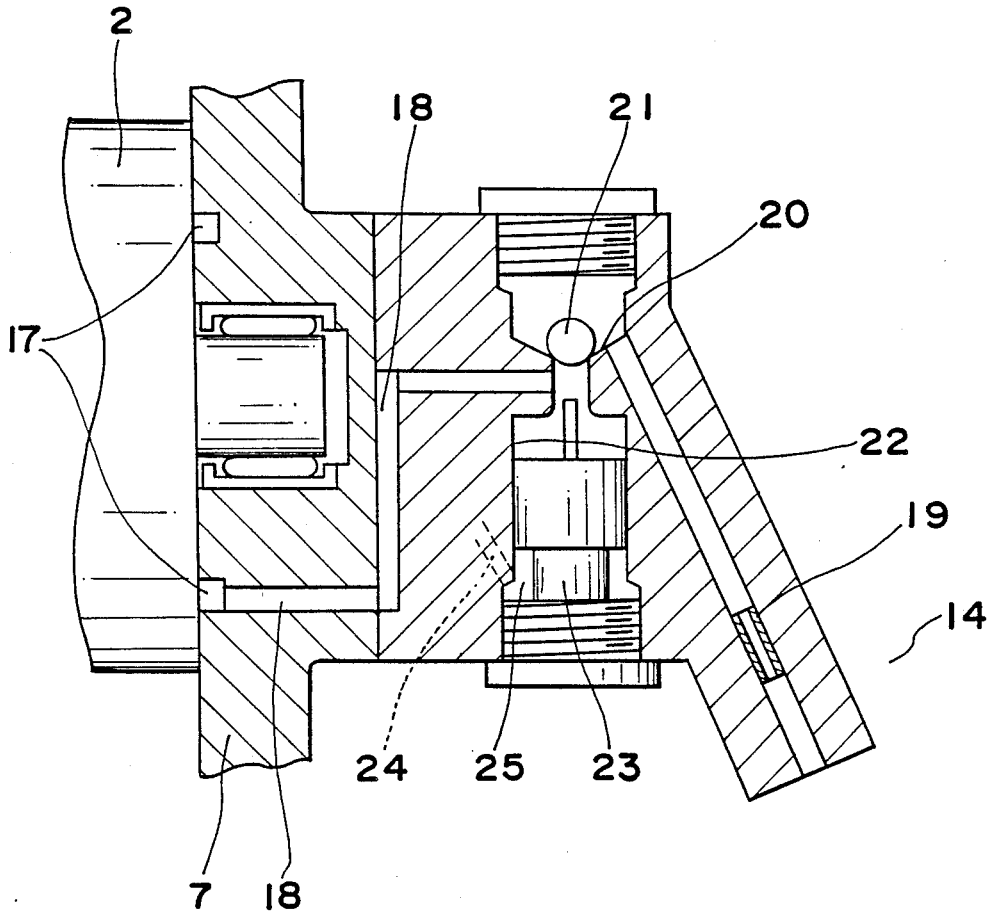
Fig. 3 PRIOR ART
FIG. 3 is an essential portion enlarged sectional view of the conventional vane backpressure providing apparatus of FIG. 1.
Figure 4:
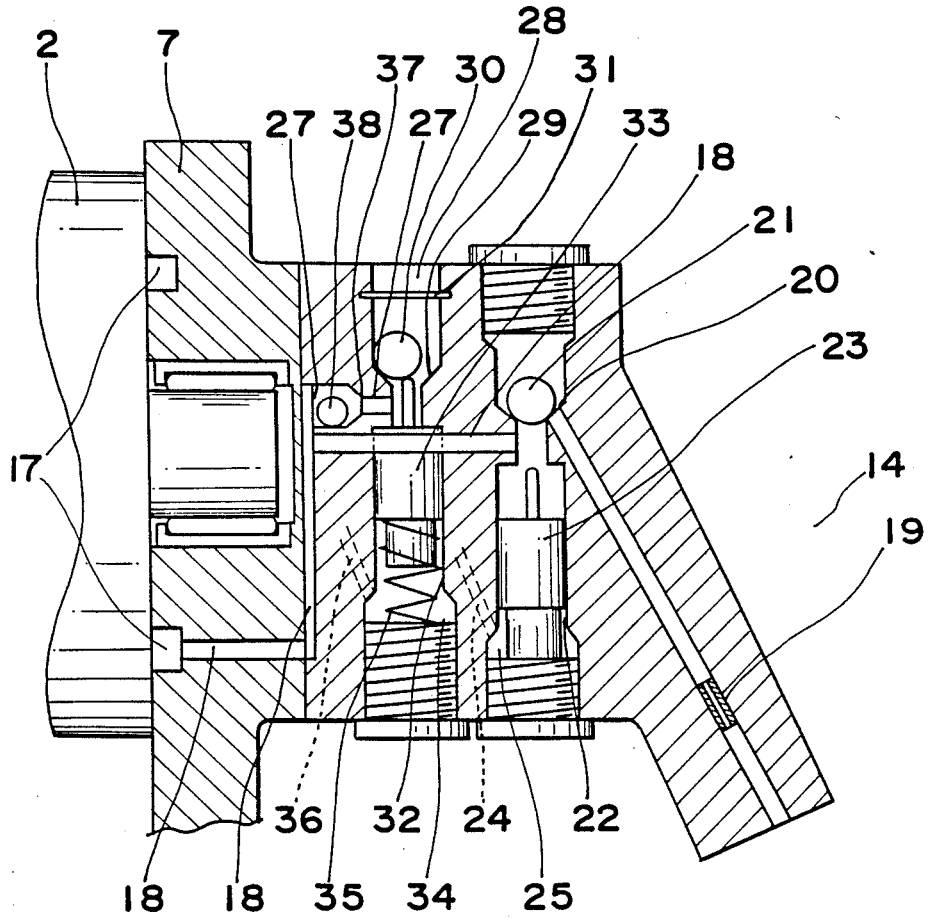
FIG. 4 is an essential-portion enlarged sectional view of a vane backpressure-providing apparatus in a first embodiment of the present invention.
Figure 5:
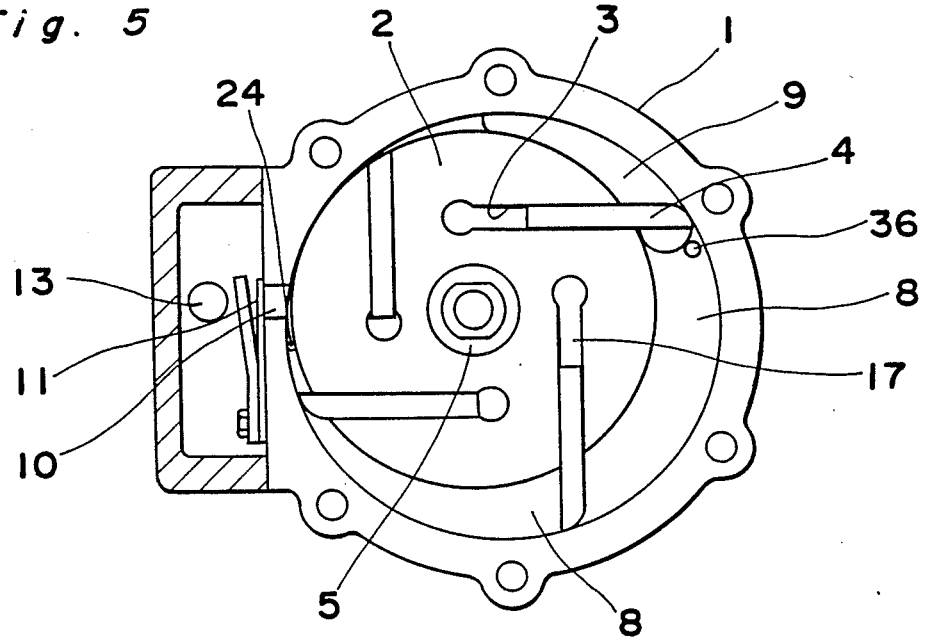
FIG. 5 is a sectional view of a sliding vane type compressor provided with a vane backpressure-providing apparatus in the first embodiment of FIG. 4 of the present invention.
Figure 6:
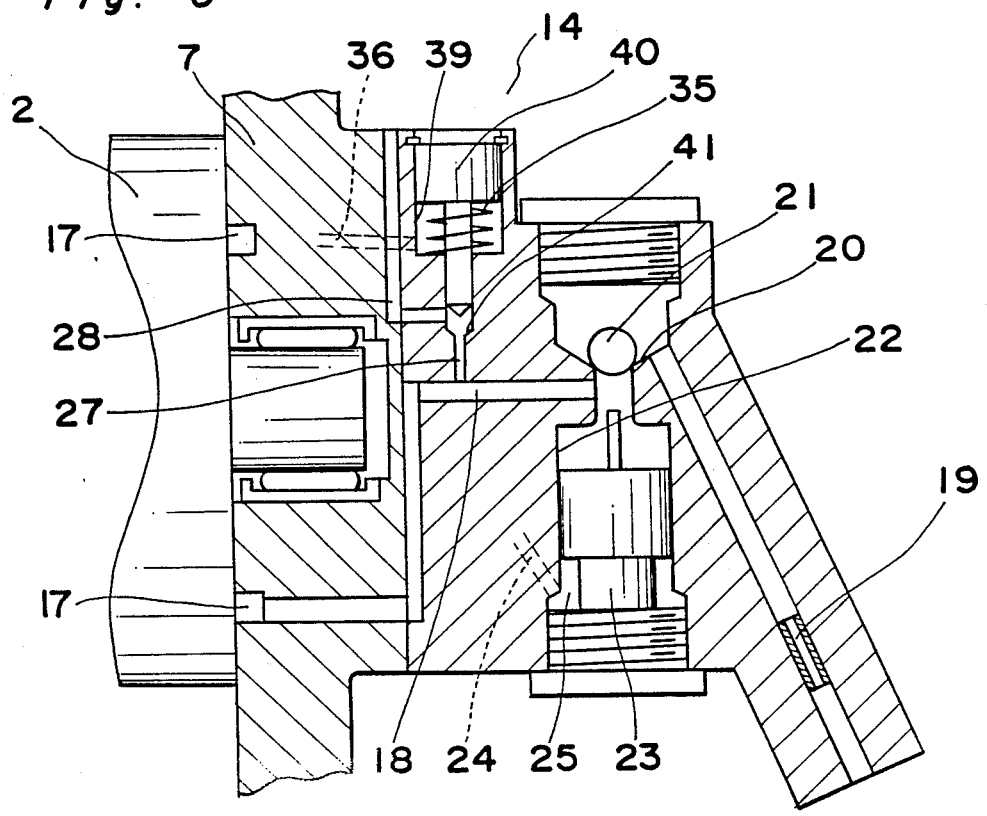
FIG. 6 is an essential-portion enlarged sectional view of a vane backpressure-providing apparatus in a second embodiment of the present invention.
Figure 7:
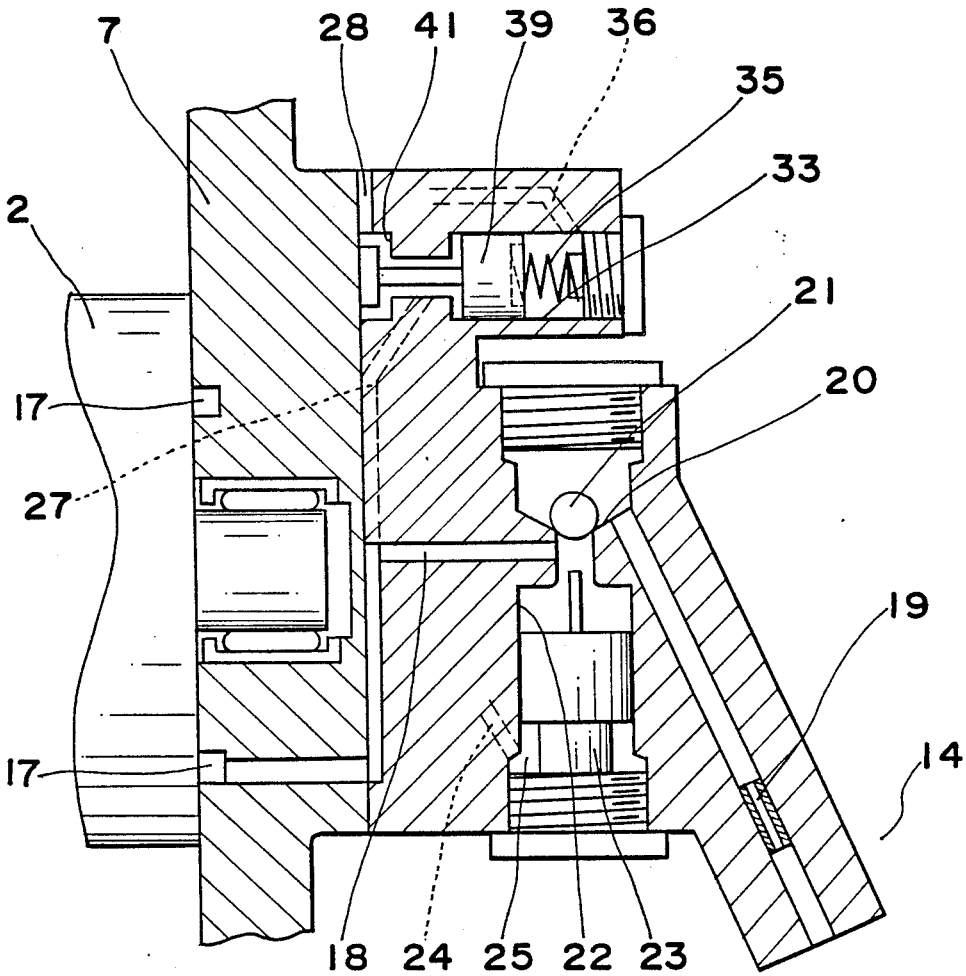
FIG. 7 is an essential-portion enlarged sectional view of a vane backpressure-providing apparatus in a third embodiment of the present invention.

Three preferred embodiments of the present invention will be described hereinafter with reference to FIG. 4 through FIG. 7 of the accompanying drawings. FIG. 4 and FIG. 5 show a first embodiment of the present invention, FIG. 6 shows a second embodiment, and FIG. 7 shows a third embodiment.

Referring now to the drawings, a sliding vane type compressor which has the same functional effect as that of the vane backpressure-providing apparatus for the conventional sliding vane type compressor is designated by like reference numerals throughout the accompanying drawings, with the description of like parts being omitted.

In the drawings, the sliding vane type compressor includes a first refrigerating fluid or gas supply passage 27 communicated at its one end with a vane backpressure chamber 17, a second refrigerating fluid or gas supply passage 28 communicating at its one end with the upper portion of a high-pressure chamber 14, a second spherical seat 29 disposed in the communicating portion between the first gas supply passage 27 and the second gas supply passage 28, a second spherical body 30 which moves off of or comes into contact with the second spherical seat 29 (i.e., body 30 opens or closes passage 28) to cause the first gas supply passage 27 to communicate with, or be shut off from the second gas supply passage 28, a stopper 31 which restricts the movement of the second spherical body 30, a second plunger chamber 32 which opens to the second spherical seat 29 on the opposite side of the second spherical body 30, a second plunger 33 which is arranged slidably in the second plunger chamber 32 to shove off the second spherical body 30 from the second spherical seat 29 when it has moved onto the side of the second spherical seat 29, a spring 35 which is located in the second lower plunger chamber 34 at the lower end of the second plunger 33 to urge the second spherical body 30 to be shoved off in a direction from the second spherical seat 29 through the second plunger 33, a second pressure introducing passage 36 communicating with the intermediate pressure portion of the second lower plunger chamber 34 at the lower end of the second plunger 33 and a working chamber 8, a third spherical body 38 disposed adjacent to the first gas spherical seat 37 communicating with the first gas supply passage 27 and communicating with the vane backpressure chamber 17, and the third spherical body 38 allows flow only in one direction of the gas fluid within the first gas supply passage 27 and also causes the fluid flow inside the first gas supply passage 27 to flow or be shut off.

The vane backpressure-providing apparatus for a sliding vane type compressor constructed as described hereinabove operates as follows.

In the steady operation condition where a pressure difference exists between the low-pressure side and the high-pressure side a certain time lapse after the start of the compressor, the excessively compressed gas within the working chamber 8 having the pressure which overcomes the pressure of the high-pressure fluid to lift a discharge valve 11 is fed into the first lower plunger chamber 25 from the first pressure introduction passage 24. Thus, the first plunger 23 moves against the side of the first spherical seat 20 to move the first spherical body 21 away from the first spherical seat 20 to open the fluid passage. Also, as the second refrigerating fluid or gas supply passage 28 communicates with the upper portion of the high-pressure chamber 14, it overcomes both the intermediate pressure of the fluid in working chamber 8 flowing into the second lower plunger chamber 34 from the second pressure introduction passage 36 and acting on second plunger 33 and the urging force of the spring 35, so that the second spherical body 30 comes into contact against the second spherical seat 29 to shut off the first gas supply passage 27 from the second gas supply passage 28.

Also, the third spherical body 38 disposed on the way to the first refrigerating fluid or gas supply passage 27 comes into contact against the third spherical seat 37, because of the higher pressure on the side of the vane backpressure 17 of the first gas supply passage 27, to shut off the first gas supply passage 27. Accordingly, the lubricating oil stored in the lower oil storing portion in the lower portion of the high-pressure chamber 14 is fed from the passage 19, through an oil supply passage 18 to the vane backpressure chamber 17, to serve for movement of the vane 4, which is similar to the vane backpressure providing apparatus of a conventional sliding vane type compressor.

Also, when the compressor stops, the pressure within the working chamber 8 rapidly falls down to the pressure of the fluid on the side of the low pressure, and the pressure within the first lower plunger chamber 25 falls down to that of the fluid on the low-pressure side. Thus, the pressure at the lower end of the first plunger 23 becomes lower than the pressure at the upper end of the first plunger 23. Accordingly, the first plunger 23 moves to the lower side of the plunger chamber 25 to cause the first spherical body 21 to come into contact against the first spherical seat 20. Also, as the high-pressure side within the refrigerating cycle and the compressor interior act upon the first spherical body 21, the pressure of the upper portion of the high-pressure chamber 14 becomes high to retain the second plunger 33 at a certain position. Namely, the second spherical body 30 comes into contact against the second spherical seat 29 to shut off the first gas supply passage 27 from the second refrigerating fluid or gas supply passage 28. Also, as the pressure of the compressor interior drops down to the pressure of the fluid on the low-pressure side, the third spherical body 38 is away from the third spherical seat 37. The lubricating oil is prevented from flowing into the working chamber 8, which is similar to the vane backpressure providing apparatus of a conventional sliding vane type compressor.

With the lapse of a certain time after the stopping of the compressor, the pressure difference between the high-pressure side and the low-pressure side becomes smaller, so that the spring 35 moves the second plunger 33 to the side of the second spherical seat 29. When the compressor has been started from this condition, the gaseous fluid is instantly fed into the vane backpressure chamber 17 from the second gas supply passage 28 through the first gas supply passage 27 and the oil-supply passage 18.

As described hereinabove, according to the present embodiment, the vane backpressure-providing apparatus for the sliding vane type compressor includes the oil supply passage 18 which causes the vane backpressure chamber 17 to communicate with the oil storing portion of the high-pressure chamber, the oil-passage opening, closing means for causing the oil-supply passage to communicate or to be off, the first gas supply passage 27 at its one end communicating with the vane backpressure chamber 17, the third spherical body 38 with the flow of the gaseous fluid being provided in only one direction on the way to the first gas supply passage 27, the second gas-supply passage 28 at its one end communicating with the upper portion of the high-pressure chamber 14, the second spherical seat 29 disposed on the way to the first gas-supply passage 27 and the second gas-supply passage 28, the second spherical body 30 which comes into contact against this spherical seat 29 or is off of seat 29 to cause the first gas-supply passage 27 to be shut off from or to communicate with the second gas supply passage 28, the plunger chamber 34 which opens onto the side of the second spherical body 30, the plunger 33 which is arranged slidably in the plunger chamber 34 to shove off the spherical body from the second spherical seat 39 when plunger 33 has moved to the side of the spherical seat, the spring 35 which is located in the lower plunger chamber 34 of the lower end of the plunger 33 to urge the second spherical body 30 in the direction away from the second spherical seat 29 through the plunger 33, and the pressure introduction passage to communication with the intermediate pressure portion of the lower plunger chamber 34 and the compressor. Thus, when the pressure difference does not exist between the fluid on the high-pressure side and the fluid on the low-pressure side, or at the start of the compressor from the smaller condition, the gas supply passage communicates. Therefore, the vane 4 rotates through the rotation of the rotor 2 to supply the gaseous fluid from the second and first gas supply passages 28, 27 instantly with respect to the volume change of the vane backpressure chamber 17 to be caused at the expansion within the vane slot 3 and the immersion into it. As the pressure reduction in the vane backpressure chamber 17 is not caused, the phenomena of failure of the vane or of inferior compression may be prevented. Also, after the starting operation, the second spherical body 30 comes into contact against the second spherical seat 29 to shut off the second and first gas supply passages 28, 27, so that a proper amount of lubricating oil is fed from the oil-supply passage 18 into the vane backpressure chamber 17 so as to enhance durability and efficiency.

FIG. 6 shows a second embodiment of the present invention. It is to be noted that like parts in FIG. 6 are designated by like reference numerals in FIG. 5 showing the first embodiment.

Referring now to the drawings, the second embodiment includes a sliding chamber 39 which opens at its one end to the high-pressure chamber 14 and communicates at its other end with- the intermediate-pressure portion of the working chamber 8 by the second pressure introduction passage 36, a sliding member 40 arranged slidably within the sliding chamber 39, a valve seat 41 which shuts off the first gas supply passage 27 and the second gas supply passage 28 only when the sliding member 40 is in contact against the valve seat.

The vane backpressure providing apparatus for a sliding member 40 is in contact with the valve seat.

The vane backpressure providing apparatus for a sliding vane type compressor constructed as described hereinabove will be described in operation hereinafter.

When the compressor stops, the pressure within the working chamber 8 suddenly drops and the pressure at the lower end of the plunger 23 also drops. Thus, the first plunger 23 moves onto the side of the first lower plunger chamber 25 to allow first spherical body 21 to come into contact against the first spherical seat 20 to shut off the oil supply passage 18, which is similar to the conventional vane backpressure providing apparatus.

While the pressure inside the high-pressure chamber 14 is high, the sliding member 40 remains in contact against the valve seat 41. But, as the pressure difference between the high-pressure side and the low-pressure side becomes small after the lapse of the certain time from the stop of the compressor, the sliding member 40 is isolated from the valve seat 41 by the urging force of the spring 35. As a result, the first gas supply passage 27 communicates with the second gas supply passage 28.

A case where the compressor has been started will be described hereinafter when the pressure difference does not exist between the high-pressure side and the low-pressure side. The vane 4 rotates following the rotation of the rotor 2 and is expanded and retracted within the vane slot 3. By the volume change of the vane backpressure chamber 17 caused at this time, the pressure within the vane backpressure chamber 17 tries to be reduced, so that the gaseous fluid is instantly supplied into the vane backpressure chamber 17 through the second gas supply passage 28, the first gas supply passage 27 from the high pressure chamber 14 so as to prevent the pressure of the vane backpressure chamber 17 from being reduced.

Also, when the pressure within the high-pressure chamber 14 that the sliding member 40 receives after the start increases to overcome the pressure of the intermediate pressure portion of the working chamber 8 and the urging force of the spring 35, the sliding member 40 comes into contact against the valve seat 41, so that the lubricating oil of a proper amount from the oil supply passage 18 may be fed into the vane backpressure chamber 17 as in the conventional vane backpressure providing apparatus.

According to the present embodiment as described hereinabove, the first and second gas supply passage for causing the oil supply passage communicating with the vane backpressure chamber 9 to communicate with the high-pressure chamber, the sliding member which receives the pressure of the high-pressure chamber at its one end, the pressure of the intermediate pressure portion of the working chamber at its other end, the spring which urges the sliding member in the direction for causing the first and second gas supply passages to communicate are provided. Thus, the pressure reduction within the vane backpressure chamber to the caused immediately after the start even when the compressor has been started from the high or low pressure equalizing condition is prevented by the supply of the gaseous fluid from the first or second gas supply passages to apply the pressure necessary for the extension of the vane, so that the failure phenomenon of the vane or the inferior compression phenomenon thereof may be prevented. Also, as the proper amount of lubricating oil may be fed into the vane backpressure chamber even during the normal operation, durability and the efficiency are enhanced.

FIG. 7 shows a third embodiment of the present invention, wherein like parts are designated by the same reference numerals as those in FIG. 6 showing the above-described second embodiment.

What is different from the second embodiment is that the valve seat 41 is arranged on the side of the communication with the high-pressure chamber 14 of the sliding chamber 33, the communication with the high-pressure chamber 14 of the sliding chamber 33 is adapted to be effected through the second gas supply passage 28. The pressure within the oil supply passage 18 is introduced through the first gas supply passage 27 into the sliding chamber 33 on the communication side of the high-pressure chamber 14 through the first gas supply passage 27 with the sliding member 39 being in contact against the valve seat 41. As the difference between the high and low pressures becomes smaller after the compressor stops, the first gas supply passage 27 communicates with the second gas supply passage 28 by the urging force of the spring 35. The gaseous fluid within the high-pressure chamber 14 may be supplied into the vane backpressure chamber from the second gas supply passage 28 at the start of the compressor. As the pressure within the high-pressure chamber 14 increases after the start to cause the sliding member 40 to come into contact against the valve seat 41 to allow the proper amount of lubricating oil to be fed into the vane high-pressure chamber, it is clear that the same operational effect as that of the above-described second embodiment is provided.

It is to be noted that the first gas supply passage 27 has been caused to communicate with the oil supply passage 18 in the first through the third embodiments. The first gas supply passage 27 may be caused to communicate with the vane backpressure chamber 17 separately from the oil-supply passage 18. Also, in these embodiments, the sliding vane type compressor of a roundness type is shown having one inlet opening 9 and one discharge opening 10 respectively, but may have a plurality of inlet openings 9 and discharge openings 10 respectively. The number of the vanes is shown to be four, and is not specified. Also, in the embodiments, the second gas supply passage 28 communicates at its one end with the upper portion of the high-pressure chamber 14 and the second pressure introduction passage 36 communicates at its one end with the intermediate pressure portion of the working chamber 8. The communication may be adapted to effect with any portion not only within the compressor, but also within the refrigerating cycle if only the second spherical body 30 or the sliding member 39 is provided in a combination where the second spherical body 30 or the sliding member 39 has a pressure difference enough to come into contact against the second spherical seat 29 or the valve seat 41 overcoming the urging force of the spring 35 in the steady operating condition of the compressor. In the embodiment, the gas passage opening, closing means which is composed of the first gas supply passage 27, the second gas supply passage 28, the second spherical seat 29, the second spherical body 30, the stopper 31, the second plunger chamber 32, the second plunger 33, the second plunger chamber 34, the spring 35, and the second introduction passage 37 are provided downstream from the oil passage opening, closing means of the oil-supply passage 18. However, a spring which urges in the direction of isolating (e.g. shoving off) the first spherical body 21 from the first spherical seat 20 may be provided in the first lower plunger chamber so that the gas passage opening, closing means may be provided upstream from the oil passage opening, closing means of the oil-supply passage. The third spherical seat 37, the third spherical body 38 are provided on the way to the first gas supply passage 27, but they do not have to be provided unless the gaseous fluid does not flow onto the side of the second pressure passage 28 from the side of the first gas supply passage 27 or onto the side of the second pressure introducing passage 36 through the second plunger chamber 32 through the combination of the portions where the second gas supply passage 28 communicates with the second pressure introduction passage 37. Also, in the first embodiment, the check valve composed of the third spherical seat 37, the third spherical body 38 are provided within the first gas supply passage 27, but a check valve composed of a valve member, a valve seat to provided the flow of the gaseous fluid only in one direction may be employed.

As is clear from the foregoing description, according to the arrangement of the present invention, the pressure reduction of the vane backportion to be caused immediately after the start even when the compressor has been started in the case where the high or low pressure difference of the compressor does not exist or is small may be prevented through the supply of the gaseous fluid from the gas passage. Also, in the steady operating condition, the proper amount of lubricating oil may be fed to the vane back portion through the interruption of the gas passage. Therefore, the failure phenomenon and the inferior compression phenomenon of the vane may be prevented without a reduction in the durability and efficiency of the compressor.

Although the present invention has been fully described by way of example with reference to the accompanying drawings, it is to be noted here that various changes and modifications will be apparent to those skilled in the art. Therefore, unless otherwise such changes and modification, depart from the scope of the present invention, they should construed as included therein.

What is claimed is:

1. A vane backpressure-providing apparatus in a sliding vane compressor comprising a cylinder having a cylindrical inner wall, a rotor rotatably disposed within said cylinder with one portion of the external periphery of said cylinder forming a micro-gap with respect to said cylindrical inner wall, at least one vane slidably inserted within a vane slot disposed in said rotor, a driving shaft integrally attached to said rotor for rotatably supporting said rotor, a front side plate and a rear side plate attached to both ends of said cylinder for closing said cylinder and for ends of said cylinder for closing said cylinder and for defining a working chamber therein, an inlet opening and a discharge opening communicating with said working chamber through a portion thereof, said portion of said working chamber being located where said rotor external periphery is adjacent to said cylindrical inner wall, a discharge valve provided in said discharge opening, a high-pressure case which separates a lubricating oil within a high-pressure refrigerating fluid communicating with and fed into said discharge opening, a high pressure chamber including an oil storage portion in a lower portion thereof, a vane backpressure chamber defined by said vane slot and said at least one vane, an oil-supply passage for causing said vane backpressure chamber to communicate with said oil storage portion of said high-pressure camber, an oil passage opening/closing means for causing said oil supply passage to communicate or to be shut off, a first refrigerating fluid supply passage communicating at its one end with said vane backpressure chamber, a second refrigerating fluid supply passage communicating at its one end with said first refrigerating fluid supply passage for introducing a refrigerating fluid from the other end thereof, a refrigerating fluid passage opening/closing means for causing said first refrigerating fluid supply passage to communicate with said second refrigerating fluid supply passage or to be shut off from said second refrigerating fluid supply passage, said refrigerating fluid passage opening/closing means including a spherical seat disposed in a fluid communication portion between said first refrigerating fluid supply passage and said second refrigerating fluid supply passage, a movable spherical body isolated from or in contact with said spherical seat for causing said first refrigerating fluid supply passage to communicate with or to be shut off from said second refrigerating fluid supply passage, a plunger chamber including an upper and a lower plunger chamber, said upper plunger chamber fluidly communicating with said fluid communication portion between said first refrigerating fluid supply passage and said second refrigerating fluid supply passage, said upper and lower plunger chambers being on the side of said spherical seat opposite to said spherical body, a plunger slidably disposed inside said plunger chamber for isolating said spherical body from said spherical seat when said plunger moves to the side of said second refrigerating fluid supply passage having said spherical seat, a spring located in said lower plunger chamber and contacting the lower end of said plunger for biasing said plunger for urging said spherical body to be isolated from said spherical seat to keep said second refrigerating fluid supply passage normally open, and a pressure introducing passage fluidly communicating with said lower plunger chamber for introducing a refrigerating fluid at a pressure lower than the pressure of a refrigerating fluid within at least said second refrigerating fluid supply passage into said lower plunger chamber during the steady-state operation of said sliding vane type compressor.

2. A device as in claim 1, further comprising a check valve having means for causing a refrigerating fluid to flow only one way to said first refrigerating fluid supply passage from said second refrigerating fluid supply passage, and said check valve being disposed on the way to said first refrigerating fluid supply passage.

* * * * *